United States Patent [19]

Steinman et al.

[11] Patent Number: 4,901,194

[45] Date of Patent: Feb. 13, 1990

[54] METHOD AND APPARATUS FOR REGULATING AIR IONIZATION

[75] Inventors: Arnold J. Steinman; Michael G. Yost, both of Berkeley, Calif.

[73] Assignee: Ion Systems, Inc., Berkeley, Calif.

[21] Appl. No.: 291,770

[22] Filed: Dec. 29, 1988

Related U.S. Application Data

[63] Continuation-in-part of Ser. No. 221,779, Jul. 20, 1988.

[51] Int. Cl.[4] ..... H05F 3/06

[52] U.S. Cl. ..... 361/213; 361/215; 361/231; 361/235; 250/423 R; 307/264

[58] Field of Search ..... 361/212, 213, 215, 229-231, 361/235; 250/324, 423 R, 424; 55/105, 123, 139; 307/350, 355, 359, 264

[56] References Cited

U.S. PATENT DOCUMENTS

| | | | |
|---|---|---|---|
| 2,264,495 | 12/1941 | Wilner | 361/231 |
| 3,624,448 | 11/1971 | Saurenman | 361/231 |
| 3,936,698 | 2/1976 | Meyer | 361/231 |
| 4,536,698 | 8/1985 | Shevalenko et al. | 323/237 |
| 4,542,434 | 9/1985 | Gehlke et al. | 361/231 |
| 4,682,266 | 7/1987 | Haynh et al. | 361/235 |
| 4,757,422 | 7/1988 | Bossard et al. | 361/231 |

OTHER PUBLICATIONS

R. H. Dunphy et al., "A Computer Controlled Air Ionizing System", date not known but prior to Oct. 17, 1985.

Voyager Technologies, Inc., "Computer Controlled Air Ionization", date not known but prior to Oct. 17, 1985.

*Primary Examiner*—A. D. Pellinen

*Assistant Examiner*—David Osborn

*Attorney, Agent, or Firm*—Phillips, Moore, Lempio & Finley

[57] ABSTRACT

Ion content of the air in a clean room or the like is controlled by generating positive and negative ions during alternating time periods using positive and negative high voltage generators connected to ionizing electrodes. Ion generation periods are followed by off intervals during which the ions disperse away from the electrodes before ions of opposite polarity are generated. In one aspect of the invention, each period of actuation of a high voltage generator of one polarity is followed by a momentary actuation of the high voltage generator of opposite polarity. This produces ions that are attracted to the electrode of the one polarity and then neutralize residual charge on the capacitors of the generator of the one polarity thereby assuring an abrupt termination of ion generation which can otherwise extend into the subsequent off period. In another aspect of the invention, each ion generation period is interrupted for an interval which varies in accordance with a feedback signal from an ion sensor in order to maintain air ion content within a desired range. The feedback signal is integrated to suppress the effects of brief localized fluctuations of air ion content on the signal thereby avoiding unnecessary over production of ions.

18 Claims, 4 Drawing Sheets

FIGURE 1
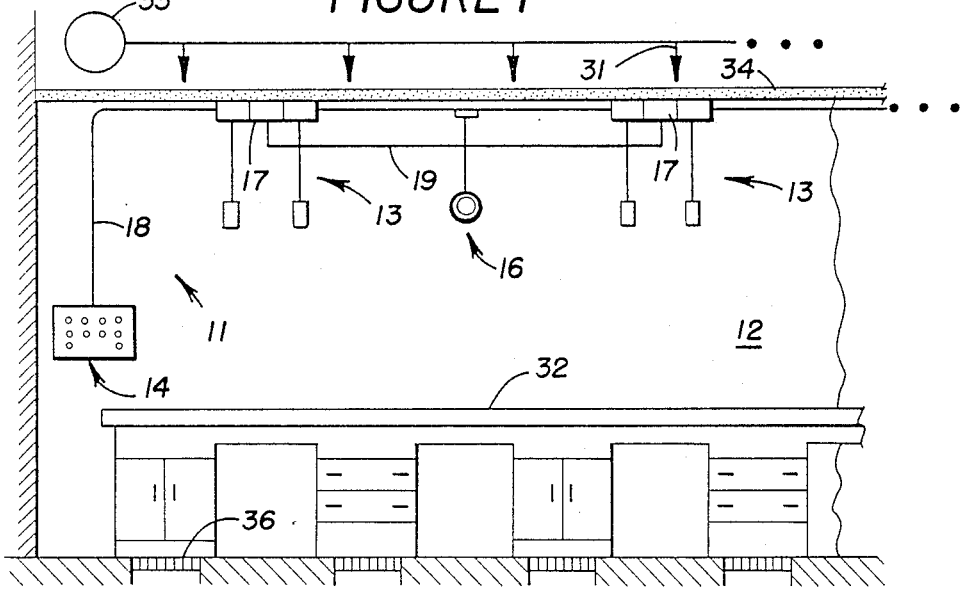
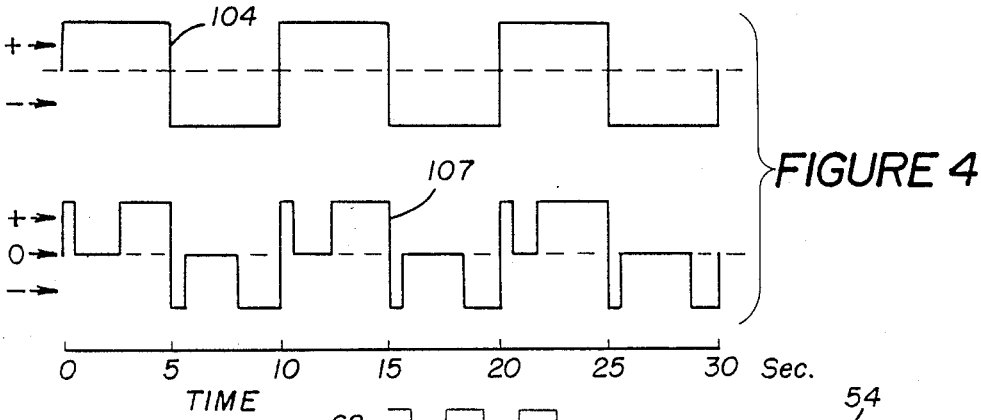
FIGURE 4
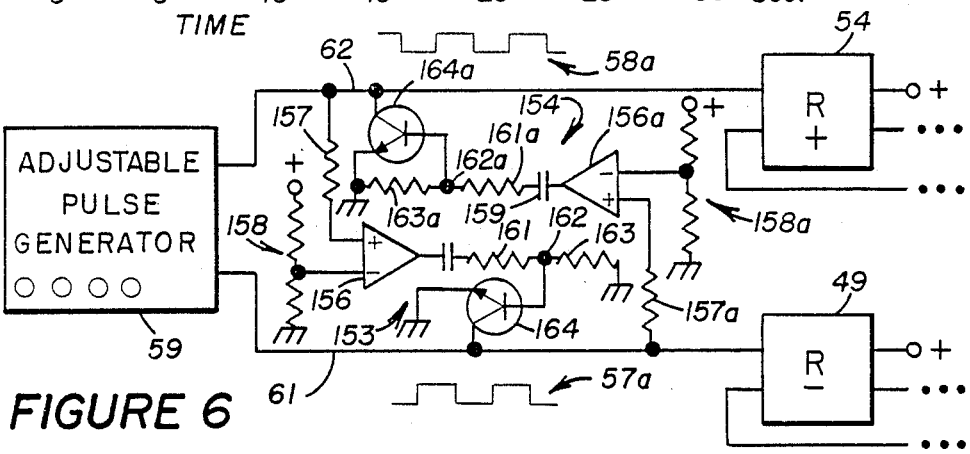
FIGURE 6

RELAY
RELAY
CONTROL CONSOLE
TIMER CIRCUIT
D.C. POWER SUPPLY

METHOD AND APPARATUS FOR REGULATING AIR IONIZATION

CROSS REFERENCE TO RELATED APPLICATION

This application is a continuation-in-part of the similarly entitled co-pending application Ser. No. 221,779 of the present applicants, filed July 20, 1988.

TECHNICAL FIELD

This invention relates to methods and apparatus for ionizing air and more particularly to the control of air ionizers for the purpose of maintaining a predetermined ion content in the air at a particular region in order to suppress static electrical charges or for other purposes.

BACKGROUND OF THE INVENTION

Accumulations of static electrical charge can cause a variety of adverse effects. Discharges of static electricity are discomforting to people and can disrupt the operation of electronic equipment such as computers. Problems with static charge build-up have become particularly acute in certain industrial operations of which the manufacture of miniaturized solid state electronic components is a prominent example.

Discharges of static electricity can destroy the minute conductive paths in microchip wafers or the like. Charge accumulations on such wafers or the like also attract particulate contaminants which can cause the product to become defective.

Maintaining a high level of air ionization in the vicinity of objects which are to be protected is a highly effective technique for suppressing static charge build-up in clean rooms where electronic components are manufactured or at other locations. Charge accumulations on objects attract air ions of opposite polarity which then neutralize the charge.

Most air ionizing systems have one or more sharply pointed electrodes to which high voltage is applied. The resulting intense electrical field near the point of the electrode dissociates molecules of the constituent gases of air into positively and negatively charged ions. Ions having a polarity or charge opposite to that of the electrode are attracted to the electrode and neutralized. Ions of similar polarity are repelled by the electrode and by each other and disperse outwardly into the surrounding air. Ion movement from the electrode to the region of objects that are to be protected is usually accelerated by providing an air flow from the electrode to the object region.

Air ionizing systems intended for static charge suppression are usually designed to generate both positive and negative ions as the charges to be suppressed may be of either polarity. This may be accomplished by using two electrodes having opposite voltages or by periodically reversing the voltage on a single electrode. Production of both types of ion simultaneously tends to reduce the effective range of the apparatus as intermixed positive and negative ions rapidly neutralize each other by charge exchange.

Prior U.S. Pat. No. 4,542,434 of Scott J. S. Gehlke et al, issued Sept. 17, 1985 and entitled "Method and Apparatus for Sequenced Bipolar Air Ionization" (assigned to the assignee of the present application) describes a method and apparatus which extends the range of bipolar air ionizers and offers other advantages as well. In the system of that patent, timing signals initiate positive and negative ion generation at spaced apart electrodes during alternate time periods which are separated by off intervals during which no ion generation occurs. This allows an air flow to carry each pulse of ions a substantial distance away from the electrodes before significant intermixing and mutual neutralization of the two types of ions begins.

Precise control of the ion output rate is desirable in apparatus of the above described kind. Effective static charge suppression at a particular location requires that the ratio of positive to negative ions be within a narrow range of values and that the total concentration of ions in the air also be at or close to an optimum value. An excess of ions of one polarity can have the counter-productive effect of imparting charge to objects. A low concentration of ions may not adequately neutralize static charges and an overly high concentration may also have adverse effects. The optimum ratio of positive to negative ions and the optimum total ion concentration that are needed vary from location to location. The optimum ratio and concentration may also vary at a particular location over a period of time because of changes in activities, equipment, air flow patterns or other conditions at the location. The air ion content at the location can also depart from the desired levels because of changes in the ionizing apparatus itself such as electrode deterioration from corrosion, utility power line voltage fluctuations or other causes.

Thus the air ionizing apparatus should enable separate adjustment of the rates of generation of both positive and negative ions and the ion content of the air at the location should be monitored so that readjustments can be made when changed conditions make that advisable.

In the system of the above identified U.S. Pat. No. 4,542,434, positive and negative electrode voltages, the timing of periods of positive and negative ion generation and the duration of the off periods between periods of ion generation can each be independently adjusted. This enables tuning of the system to provide a ratio of positive to negative ions and a total ion concentration that is suited to the needs of the particular location where the system is installed. Ion levels at the site can then be monitored with sensing instruments and manual readjustments can be made when changed conditions make that necessary.

Bipolar air ionizers of the above discussed kind have at least one negative ion producing electrode coupled to a negative high voltage generator and at least one positive ion producing electrode connected to a positive high voltage generator. A control system produces cyclical timing signals that alternately actuate the negative and positive high voltage generators so that production of only one type of ion occurs at any given time. This avoids an immediate neutralization of ions which would otherwise occur from charge exchange between the ions of opposite polarity. The control system can also be adjusted to provide an off interval following each actuation of a high voltage generator during which neither generator is actuated. Ions of each polarity may then travel a substantial distance away from the electrodes before ions of the opposite polarity are produced. This extends the effective range of the air ionizing system by delaying the intermixing of ions of opposite polarity and thereby delaying neutralization by mutual charge exchange.

Heretofore, a characteristic of the high voltage generators has resulted in an undesirable prolongation of ion production following each ion generation period as called for by the timing system. Each high voltage generator contains capacitors which are charged up to a high voltage level each time the generator is actuated by the control system. A period of time is required for discharge of the capacitors after the control system has deactuated the high voltage generator. Consequently, ion production continues to occur for a limited period, at a diminishing rate, during the off intervals called for by the control system. This reduces precision of control of ion production rate and timing and reduces the effectiveness of the off intervals for extending the range of the air ionizer in the manner described above. The problem becomes particularly pronounced in situations where there is a low air flow rate in the vicinity of the ionizing electrodes as the residually produced ions are not quickly carried away from the electrode region.

Another problem can be encountered with such bipolar air ionizing systems under certain operating conditions. As previously pointed out, changes in the total ion output and/or the ratio of negative and positive ion output rates may be desirable during operation because of changes in activities, equipment, air flow patterns or other conditions at the location where static charges are to be suppressed. Monitoring of the ion content of the air and adjustment of negative and/or positive ion output can be done manually but it is often more advantageous to provide a feedback system which does this automatically and continually in response to signals from an air ion sensor.

The need for changes in ion output may vary at different locations in a room. Different rates of ion output, at the different locations can be provided for by using a plurality of spaced apart pairs of positive and negative air ionizers with each pair having its own individual ion sensor and feedback circuit. This degree of localized control is not needed in some installations and cost considerations, lack of space or other factors may dictate that a single sensor and feedback circuit be used control all or a group of such pairs of air ionizers. Prior feedback circuits, designed for individual control of a single air ionizer, are not ideally suited for joint control of a group of spaced apart units of the above described kind. The single sensor and feedback circuit responds immediately to momentarily fluctuations of ion content at one particular location in the room. These fluctuations are not necessarily indicative of conditions at other locations in the room. Consequently, the single sensor and feedback circuit may cause changes in the rate of ion production and/or the ratio of negative to positive ions at the other locations at times when such changes are not needed at the particular location.

The present invention is directed to overcoming one or more of the problems discussed above.

SUMMARY OF THE INVENTION

In one aspect, the present invention provides a method of maintaining the ion content of the atmosphere at a predetermined location within a desired range which includes the steps of alternating periods of positive ion generation with periods of negative ion generation and suppressing generation of ions of both polarities during intervals which precede each ion generation period. Further steps include momentarily generating negative ions between each of said periods of positive ion generation and the following one of said intervals of suppressed ion generation and momentarily generating positive ions between each of said periods of negative ion generation and the following one of said intervals of suppressed ion generation.

In another aspect of the present invention, a method of controlling the ion content of the atmosphere at a predetermined location includes the sequence of steps comprising: generating ions of a first polarity in the atmosphere during a first limited time period, generating ions of the opposite polarity in the atmosphere during a relatively brief second time period, suppressing ion generation during a third time period, generating ions of the opposite polarity during a fourth time period, generating ions of the first polarity during a relatively brief fifth time period, and suppressing ion generation during a sixth time period. The above described sequence of steps is performed repetitively.

In another aspect, the invention provides apparatus for controlling the ion content of the atmosphere at a predetermined location, the apparatus being of the type having at least one positive ion emitter and at least one negative ion emitter and control means for cyclically actuating and deactuating the ion emitters with periods of positive ion emission being alternated with periods of negative ion emission and with each period of ion emission being preceded by an interval during which emission of ions of both polarities is suppressed. First circuit means are provided for causing a relatively brief actuation of the negative ion emitter between each of the periods of positive ion emission and the following one of the intervals of ion emission suppression. Second circuit means cause a relatively brief actuation of the positive ion emitter between each of the periods of negative ion emission and the following one of the intervals of ion emission suppression.

In another aspect of the invention, apparatus for maintaining the ion content of the atmosphere at a predetermined location within a desired range includes first and second spaced apart air ionizing electrodes, a positive high voltage generator coupled to the first electrode and a negative high voltage generator coupled to the second electrode. Control means cyclically actuate and deactuate the positive and negative high voltage generators with periods of actuation of the positive high voltage generator being alternated with periods of actuation of the negative high voltage generator, each period of actuation of a high voltage generator being preceded by an interval during which both high voltage generators are deactuated. An ion sensor detects the ion content of the atmosphere and has means for producing a signal indicative of the magnitude and net polarity of the ion content of the atmosphere. Feedback means vary the ion outputs of the high voltage generators during the ion generation periods in response to the signal to maintain the ion content within the desired range. The apparatus further includes means for momentarily actuating the negative high voltage generator after each of the periods of actuation of the positive high voltage generator and for momentarily actuating the positive high voltage generator after each of the periods of actuation of the negative high voltage generator.

In a further aspect of the invention, a method for maintaining the ion content of the atmosphere at a predetermined location within a desired range includes the step of generating positive and negative ions at spaced apart points in the atmosphere with periods of positive ion generation being alternated with periods of negative ion generation. Each period of ion generation is preceded by an interval during which generation of both positive and negative ions is suppressed. A feedback signal is produced by sensing changes in the ion content of the atmosphere which signal has a magnitude and polarity that varies in accordance with variations of the magnitude and net polarity of the ion content of the atmosphere at the particular location. The signal is integrated to suppress the effect of brief fluctuations of atmospheric ion content that do not persist through a plurality of the ion generation periods. The amount of the ions that are generated during the periods of positive and negative ion generation is varied in response to the integrated signal to maintain the ion content within the desired range.

In still another aspect of the invention, apparatus for maintaining the ion content of the atmosphere at a predetermined location within a desired range is provided with a plurality of spaced apart air ionizing electrodes including at least a first electrode and a second electrode. A plurality of high voltage generators include a positive high voltage generator coupled to the first electrode and a negative high voltage generator coupled to the second electrode. Control means cyclically actuate and deactuate the positive and negative high voltage generators with periods of actuation of the positive high voltage generator being alternated with periods of actuation of the negative high voltage generator and with each period of actuation of a high voltage generator being preceded by an interval during which both high voltage generators are deactuated. A sensor detects the ion content of the atmosphere and has means for producing a signal which has a magnitude and polarity that varies in accordance with variations of the magnitude and net polarity of the ion content of said atmosphere. Means are provided for integrating the signal to produce an integrated signal that varies primarily in response to changes in the ion content that persist through a plurality of actuations of the high voltage generators and in which the effect of relatively brief fluctuations in the ion content of the atmosphere is suppressed. Feedback means vary the outputs of the high voltage generators during the ion generation periods in response to the integrated signal to maintain the ion content within the desired range.

The invention, in certain of the above defined aspects, enables a more efficient and precise control of the ion content of air at a particular region and can increase the effective range of the ionizing apparatus by causing a more abrupt termination of ion generation after each of the cyclical ion generation periods that are called for by the control system. Periods of positive ion generation are followed by a momentary actuation of the negative ion emitter. The resulting negative ions are electrostatically attracted to the positive ionizing electrode and then neutralize the residual charge on the capacitors of the positive high voltage generator. This quickly stops positive ion generation which would otherwise continue for a substantial time during the off interval which the control system establishes after each ion ion generation period. Periods of negative ion generation as called for by the control system are similarly followed by a momentary actuation of the positive ion emitter in order to abruptly discharge the capacitors of the negative high voltage generator.

In another particular form, the invention prevents over-reaction of the feedback system in air ionizing installations of the type that are controlled by a feedback signal from a sensor that monitors air ion content. Brief fluctuations in the signal are suppressed. The system then responds to changes in air ion content that persist through a plurality of cycles of ion generation rather than to momentary fluctuations of ion content in the particular region of the sensor that may not necessarily be indicative of conditions at other regions where ion content is being controlled.

BRIEF DESCRIPTION OF THE DRAWINGS

FIG. 1 is an elevation section view depicting an embodiment of the invention installed in a clean room of the type in which electronic circuit components are processed.

FIG. 4 is a graphical diagram depicting a typical ion pulse timing in the apparatus of the preceding figures and also depicts electrical waveforms in certain portions of the circuit that cause the depicted timing.

FIG. 6 diagramatically depicts a portion of another embodiment of the invention adapted for use in air ionizing installations that do not employ feedback and in which ion generation periods are of fixed duration.

DETAILED DESCRIPTION OF THE PREFERRED EMBODIMENTS

Figure 2:
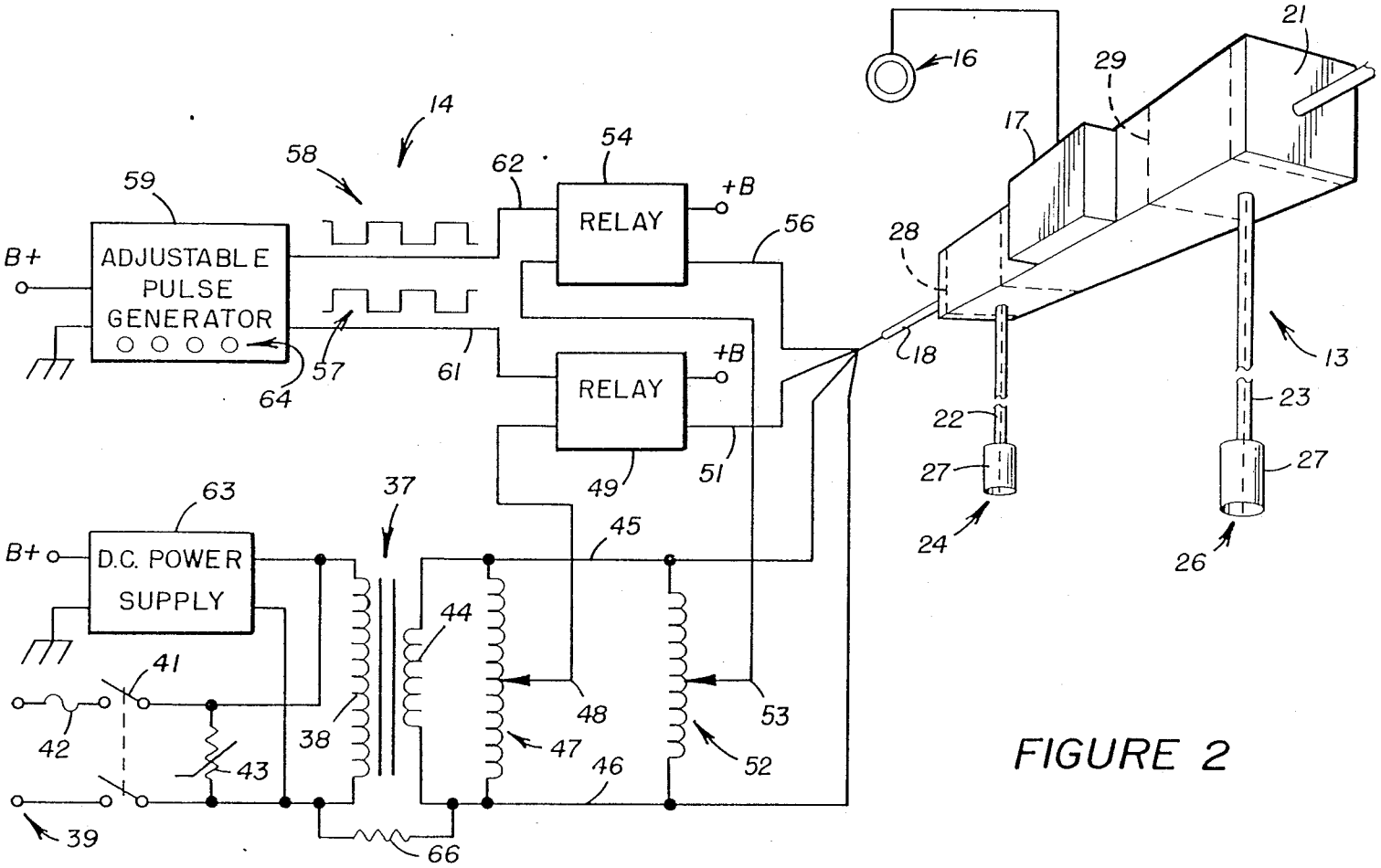
FIG. 2 is in part a perspective view of an individual ion emitter unit of the system of FIG. 1 and in part a schematic circuit diagram of the low voltage power supply and timing signal circuit of the apparatus.

Referring initially to FIG. 1, air ionizing apparatus 11 in accordance with this embodiment of the invention is shown, for purposes of example, as an installation in a clean room 12 in which electronic components are manufactured and in which significant accumulations of electrostatic charge are to be suppressed to avoid damage to the products. Similar ionizing apparatus 11 may be used at other locations where static charge suppression is needed or where control of the ion content of the atmosphere is desirable for other purposes.

Major components of the ionizing apparatus of FIG. 1 include one or more ion emitter units 13 which are typically secured to the ceiling of the room 12, a control console 14 which may, for example be attached to a wall of the room at an accessible location, one or more ion sensors 16 that are located to be exposed to the air in the room such as by being suspended from the ceiling in this example and one or more feedback modules 17 which are preferably located close to the emitter units 13. A four conductor electrical cable connects the control console 14 with each of the emitter units 13 and one or more additional four conductor cables 19 connect each sensor 16 with one or more of the feedback modules 17 as will hereinafter be described in more detail.

The emitter units 13 may be of the construction described in the above identified U.S. Pat. No. 4,542,434. Thus, with reference to FIG. 2, each emitter unit 13 has a housing 21 from which two spaced apart insulative tubes 22 and 23 extend downward. Needle shaped ionizing electrodes 24 and 26 are situated at the lower ends of tubes 22 and 23 respectively and extend axially within cylindrical guards 27, the pointed ends of the electrodes being exposed to the surrounding air.

Housing 21 contains a negative high voltage supply 28 which is connected to electrode 24 through tube 22 and a positive high voltage supply 29 connected to electrode 26 through tube 23. The high voltage supplies 28 and 29 may be voltage amplifiers of the known form that rectify, smooth and amplify a low voltage alternating input current to provide a D.C. high voltage output that can be varied by changing the input voltage.

High voltage supplies 28 and 29 are actuated alternately by the control console 14 as will hereinafter be described in more detail and under most operating conditions the resulting alternate periods of positive and negative ion generation at electrodes 26 and 24 are separated by periods of no ion generation. Consequently the pulses of ions of each polarity may disperse away from the electrode 24 or 26 for a substantial distance before intermixing of the two types of ions occurs. This delays the process of mutual neutralization by charge exchange and allows the apparatus 11 to maintain a high level of air ionization at locations which may be a substantial distance away from the emitter units 13.

Referring again to FIG. 1, an air flow 31 is usually provided to speed the travel of ions from the emitter units 13 to the region, work table 32 in this instance, where static charge accumulations are to be suppressed. In a typical clean room 12, a fan 33 forces the air flow 31 downward through porous ceiling members 34. The air flow 31 may leave the room through gratings 36 at the floor. The air flow 31 aids in maintaining a high level of air ionization at work table 32 as it decreases the travel time of ions to the work table and thereby reduces ion losses from charge exchange between the positive and negative ions.

While only two emitter units 13 are depicted in FIG. 1, a larger number are usually provided in a typical clean room 12. The emitter units 13 are typically arranged in an array with the units being several feet apart. The spacing of emitter units 13 need not necessarily be uniform as units may be situated over particular locations where problems with static charge are particularly pronounced.

Each emitter unit 13 may be provided with its own sensor 16 and feedback module 17 where very precise regulation of air ion content is needed but this is not necessary in many cases. In some instances a single sensor 16 and feedback module 17 may be connected to all emitter units 13 or a single sensor and module may be connected to a group of nearby emitter units. Ideally, the sensor 16 is situated at the location where static charge suppression is most critical, work table 32 in this instance, but often that is not practical because of the risk of damage or disturbance that could alter the sensor signal. The sensor 16 should be at a location where those risks are not present and in this example, the sensor is suspended from the ceiling of room 12 approximately at the elevation where ion generation occurs. The sensor 16 should be located away from the immediate vicinity of the emitter units 13 as there is minimal intermixing of positive and negative ions at that location and air ion content at that region is not closely representative of conditions at the work table 32. The construction and operation of the sensor 16 will be hereinafter described.

Referring again to FIG. 2, the control console 14 generates timing signals which define alternating time periods for negative and positive ion generation. (Each such ion generation time period is temporarily interrupted for an interval during which both high voltage supplies 28 and 29 are deactuated as will hereinafter be described in more detail.) The circuit of console 14 enables independent selection of the duration of the negative and positive ion generation periods 28 so that the ion output of the apparatus 11 can be adjusted to meet the needs of the particular location where it is installed.

The control console 14 has a voltage step-down transformer 37 with a primary winding 38 that is connected to utility power input terminals 39 through an on-off switch 41 and a protective fuse 42. A varistor 43 is connected in parallel with primary winding 38 to protect the circuit from power line surges and transients.

Transformer 37 reduces the voltage of the utility line alternating current to a value of 48 volts in this example. Such voltage step down is advantageous although not essential, as it enables use of light low cost electrical cabling 18 to connect the console 14 and emitter units 13.

The secondary winding 44 of transformer 37 is connected between first and second low voltage power conductors 45 and 46 respectively which extend on through cable 18 to the emitter units 13. Conductors 45 and 46 supply operating current to certain components of the emitter units 13 and feedback modules 17 as will hereafter be further described.

A first Variac or adjustable autotransformer 47 is connected between low voltage conductors 45 and 46 to enable selection of the A.C. voltage that is applied to the negative high voltage generators 28. This in turn enables adjustment of the maximum output rate of negative ions that will occur during periods of negative ion generation. The adjustable output tap 48 of autotransformer 47 connects with the emitter units 13 through a first normally open solid state relay 49 and another conductor 51 of cable 18.

A second similar autotransformer 52 is connected between low voltage conductors 45 and 46 to provide for selection of the maximum output rate of positive ions during the periods of positive ion generation. The adjustable tap 53 at the output of autotransformer 52 connects with the emitter units 13 through a second normally open solid state relay 54 and still another conductor 56 of cable 18.

The relays 49 and 54 are periodically closed in an alternating manner, to alternately transmit actuating current for the negative and positive high voltage generators 28 and 29, by timing signals 57 and 58 respectively from a pulse generator 59 of the known form that produces pulsed signals of selectable wave shapes. A suitable detailed circuit for an adjustable pulse generator 59 of this type is described, for example, in the hereinbefore identified U.S. Pat. No. 4,542,434 at column 9, line 64 to column 12, line 11, of that patent.

Timing signal 57 alternates between a first signal condition that initiates actuation of the negative high voltage supplies 28 and a second signal condition at which those high voltage supplies are off. Timing signal 58 similarly alternates between the first and second signal conditions to periodically initiate actuation of the positive high voltage supplies 29 during intervals when the negative high voltage supplies are off. (It may be noted that the above identified pulse generator of prior U.S. Pat. No. 4,542,434 enables introduction of an off interval of selectable duration following each ion generation period of either polarity. For purposes of the present invention the off interval duration is adjusted to zero or near zero so that each ion generation period is immediately or almost immediately followed by an ion generation period of the opposite polarity. Cyclical off intervals normally occur in the operation of the present invention but are produced by a feedback circuit to be hereinafter described rather than by timing signal generator 59.)

A pair of signal conductors 61 and 62 of pulse generator 59 connect with a D.C. power supply 63 through the driver circuits of relays 49 and 54 respectively. The pulse generator 59 generates the above described timing signals 57 and 58 by periodically grounding each signal conductor 61 and 62 in an alternating relationship. Thus the relays 49 and 54 are alternately closed to alternately transmit operating current for the negative and positive high voltage supplies 28 and 29. Manually adjustable controls 64 of a pulse generator of the above described type enable separate adjustment of the duration of the cyclical periods of negative and positive ion generation. As will be apparent from the following description of the feedback process, these preselected durations are in effect maximum durations as the feedback operations act to interrupt the periods of ion generation for varying intervals in order to regulate air ion content under changing conditions.

Direct current operating voltage for the pulse generator 59 and relays 49 and 54 is provided by the D.C. power supply 63 which is connected in parallel with the primary winding 38 of input transformer 37. A high resistance 66 is connected across the primary and secondary windings 38 and 44 of input transformer 37 to enable cable conductor 46 to function as a common or chassis ground conductor for the emitter units 13, sensors 16 and feedback modules 17.

Figure 3:
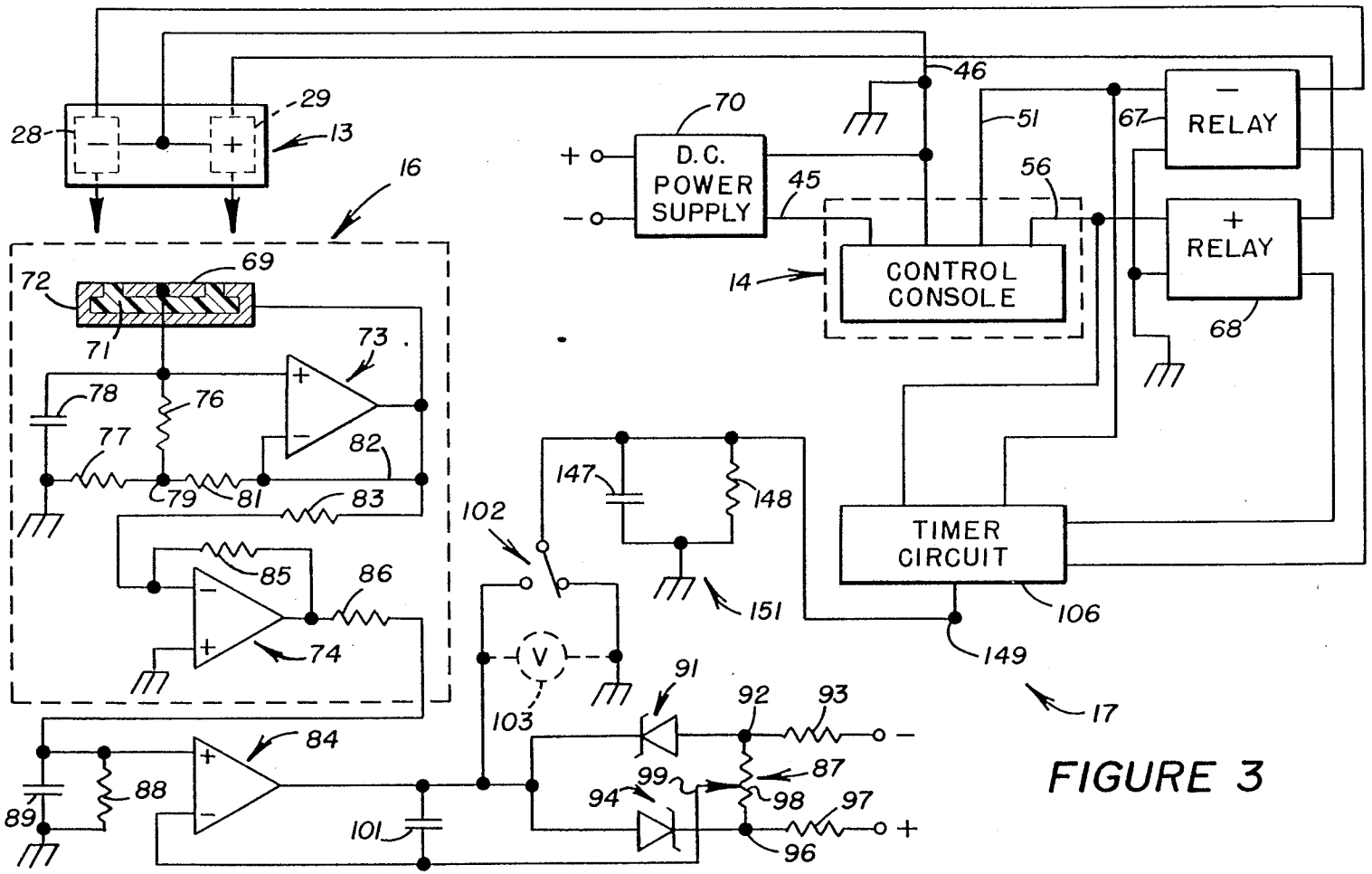
FIG. 3 is a circuit diagram of the ion sensor and also the feedback circuit of the apparatus of the preceding figures.

Referring now to FIG. 3, the previously described cable conductor 51 which periodically transmits actuating current for the negative high voltage supply 28 of emitter unit 13 is coupled to that high voltage supply through a a first normally open relay 67 of feedback module 17. The cable conductor 56 providing actuation current for the positive high voltage supply 29 is coupled to that supply through a second similar relay 68. The relays 67 and 68 enable feedback circuit 17 to vary the effective durations of these periods in response to an air ion content signal from sensor 16.

The cable conductor 46 which defines a chassis ground for the feedback module 17, ionizing unit 13 and sensor 16 is directly connected to the high voltage supplies 28 and 29. Ground symbols in FIG. 3 designate a conductive connection to cable conductor 46.

A direct current power supply 70 in the feedback module 17 is connected across the low voltage alternating current conductor 45 and common or chassis ground conductor 46 to provide positive and negative D.C. voltages, each of 15 volts magnitude in this example, for operating the hereinafter described components of the feedback module and sensor 16 that require D.C. operating current.

The sensor 16 of this example has a circular conductive disc 69 secured to one face of a circular insulative printed circuit board 71. Board 71 is disposed within a conductive shield 72 which also encircles the periphery of disc 69 in spaced apart relationship from the disc. Circuit components of the sensor 16, such as amplifiers 73 and 74 are shown by symbols in FIG. 3 to facilitate understanding of the Circuit but are actually mounted on the circuit board 71 within shield 72. Sensors 16 having other configurations may also be used. A v-shaped plate or a cylinder may, for example, be substituted for the disc 69.

Disc 69 is connected to chassis ground through a high resistance 76 and a relatively small resistance 77 that are connected in series relationship. A capacitor 78 is also connected between the disc 69 and ground. Thus an imbalance of positive or negative air ions at the surface of disc 69 results in a current flow through resistors 76 and 77 and a voltage drop across resistor 76 that is indicative of the magnitude and polarity of the imbalance. The positive or non-inverting input of amplifier 73 is connected to disc 69 and the negative or inverting input of the amplifier is connected to the output of the amplifier and also to the circuit junction 79 between resistors 76 and 77, through a resistor 81. Thus a feedback signal voltage is generated which changes in response to changes of the voltage drop across resistor 76.

As resistor 81 is connected to the junction 79 rather than directly to ground, the amplifier 73 is in the so called bootstrap configuration which results in a multiplication of the effective resistance of resistor 76 by the ratio of the value of resistor 77 to the value of resistor 81.

Capacitor 78 and the multiplied resistance of resistor 76 defines an integrating circuit which provides a limited degree of signal integration so that the response of the sensor 16 to changing ion ratios matches that of an ionization detector instrument that is used to initialize the adjustments of the ionizing apparatus as will hereinafter be described. In this particular example, the values of resistors 76, 77, 81 and capacitor 78 are selected to provide an effective time constant of 200 seconds. This time constant enables fast response to changes of ion content in the air.

Amplifier 73 exhibits unity gain as the output is fed back to the negative input through a conductive path 82 that has no significant resistance. The output of amplifier 73 is also connected to the sensor shield 72 to assure that the shield is always at the same voltage as disc 69. This avoids any flow of leakage current, which could distort the feedback signal, between the disc 69 and shield 72.

The feedback signal is transmitted from the sensor 16 to the feedback module 17 through a buffer-inverter amplifier 74. The output voltage from integrator amplifier 73 is applied to the negative input of amplifier 74 through a resistor 83, the positive input of the amplifier being grounded. The output of the amplifier is coupled to the negative input through a feedback resistor 85.

The feedback signal voltage from the output of buffer amplifier 74 is transmitted to the positive input of a D.C. level shifting amplifier 84 of the feedback module 17 through a resistor 86. The D.C. level of the feedback signal voltage from sensor 16 may not be symmetrical about the zero level but may instead be biased towards a positive or negative mean voltage level. This can occur if the sensor 16 is not symmetrically located relative to the positive and negative ionizing electrodes 24 and 26, because of the proximity of grounded objects, or if a preponderance of ions of one polarity has been deliberately selected or for other reasons. Amplifier 84 in conjunction with a manually adjustable potentiometer 87 enables the feedback signal voltage to be balanced about the zero level.

In particular, a signal integrating resistor 88 and capacitor 89 are connected between the positive input of amplifier 84 and chassis ground The amplifier output connects to the negative D.C. power supply terminal through a zener diode 91, a circuit junction 92 and a resistor 93 and is also connected to the positive power supply terminal through another zener diode 94, another circuit junction 96 and another resistor 97. Diode 91 transmits positive current away from the output of amplifier 84 when the amplifier output voltage reaches a predetermined positive value in relation to the voltage at junction 92 and zener diode 94 transmits positive current towards the amplifier 84 output when the output voltage reaches a predetermined negative level in relation to the voltage at circuit junction 96. The resistive element 98 of potentiometer 87 is connected across junctions 92 and 96 and the movable tap 99 of the potentiometer connects to the negative input of amplifier 84. A capacitor 101 is coupled between the output and negative input of the amplifier.

The output of amplifier 84 is coupled to further components of the feedback module 17 through a mode control switch 102. During the initial adjustment of the system, switch 102 is positioned to decouple the amplifier 84 from such further components to deactivate the feedback process. A voltmeter 103 or other voltage monitor is then temporarily connected between ground and the output of amplifier 84. Potentiometer 87 may then be adjusted to change the reference voltage that is applied to the negative input of amplifier 84 until voltmeter 103 indicates that the feedback signal level has been shifted into symmetry about the zero voltage level.

Under most conditions, the feedback signal from amplifier 84 oscillates between positive and negative voltage levels in response to the alternating periods of positive and negative ion generation. The feedback circuit 17 responds to a sustained positive or negative voltage level that exceeds a pre-selected value by shortening the duration of the periods of generation of ions of that polarity and by extending the duration of the periods of generation of ions of opposite polarity. This holds the ratio of positive to negative ions at the work site and the concentration of each type of ion at the work site within a narrow range of values.

If the relays 67 and 68 remained in the closed condition throughout operation of the system, periods of actuation of the negative high voltage supply 28 would alternate with periods of actuation of the positive high voltage supply 29. The apparatus would be continuously generating ions of one polarity or the other as depicted graphically by cycling waveform 104 in FIG. 4. Referring again to FIG. 3, the feedback module 17 includes a timer circuit 106 which controls the relays 67 and 68 and which in effect temporarily interrupts each ion generation period that is called for by the control console 14 for an interval that is determined by the feedback signal from amplifier 84. In particular, timer circuit 106 momentarily closes relay 67 immediately after each positive ion generation period to produce a brief burst of negative ions and then opens relay 67 for an interval dependent on the magnitude and polarity of the feedback signal at the time. Following that off interval, the timer circuit 106, recloses relay 67 to resume the generation of negative ions until the control console 14 ends the negative ion generation period in the manner previously described by de-energizing cable conductor 51 and energizing conductor 56. The timer circuit 106 then responds by cycling the other relay 68 in a similar manner during the following positive ion generation period. These actions of the timer circuit 106 convert the ion generation sequence 104 of FIG. 4 that is called for by the control console into the actual ion generation sequence depicted by wave form 107 in FIG. 4.

The interruption of each ion generation period quickly follows the beginning of the period, typically after 100 milliseconds of ion generation for example although other timings may also be appropriate. The duration of these momentary ion generations appears longer in FIG. 4, than is typically the case owing to the relatively long time scale of FIG. 4.

Thus, with reference again to FIG. 2, each period of generation of positive ions at electrode 26 is immediately followed by a relatively brief pulse of negative ions from the nearby electrode 24. This has the beneficial effect of abruptly terminating positive ion production by electrode 26. The negative ions are electrostatically attracted to the positive electrode 26 and then act to neutralize residual charge in the capacitance of the positive high voltage generator 28. Such charge would otherwise cause continued generation of positive ions into what is intended to be an interval of suppressed ion generation. A similar effect is achieved by the burst of positive ions from electrode 26 which follows each sustained period of negative ion generation at the nearby electrode 24.

Referring again to FIG. 3, the off intervals of suppressed ion generation that occur shortly after the end of each ion generation period allow the pulses of ions of each polarity to travel further away from the ion emitter units 13 before intermixing occurs with the subsequent pulse of ions of opposite polarity. This extends the range of the apparatus by delaying mutual neutralization of the two types of ion by charge exchange.

The above described action of timer circuit 106 regulates the rate of production of each type of ion in response to the feedback signal from amplifier 84 by varying the durations of the off intervals as needed for the purpose. In particular, a feedback signal from amplifier 84 that becomes more negative causes timer circuit 106 to open relay 67 for longer intervals during the negative ion generation periods and to open relay 68 for shorter intervals during those ion generation periods as depicted in the actual ion generation sequence waveform 107 of FIG. 4. This increases the output of positive ions and decreases negative ion production thereby counteracting the air ion imbalance that caused the feedback signal to go more negative. Similarly, the timer circuit 106 shortens the off intervals during negative ion generation periods in response to a feedback signal which becomes more positive and lengthens the off intervals during periods of positive ion production. This corrects the air ion imbalance that caused the positive swing in the feedback signal.

Figure 5:
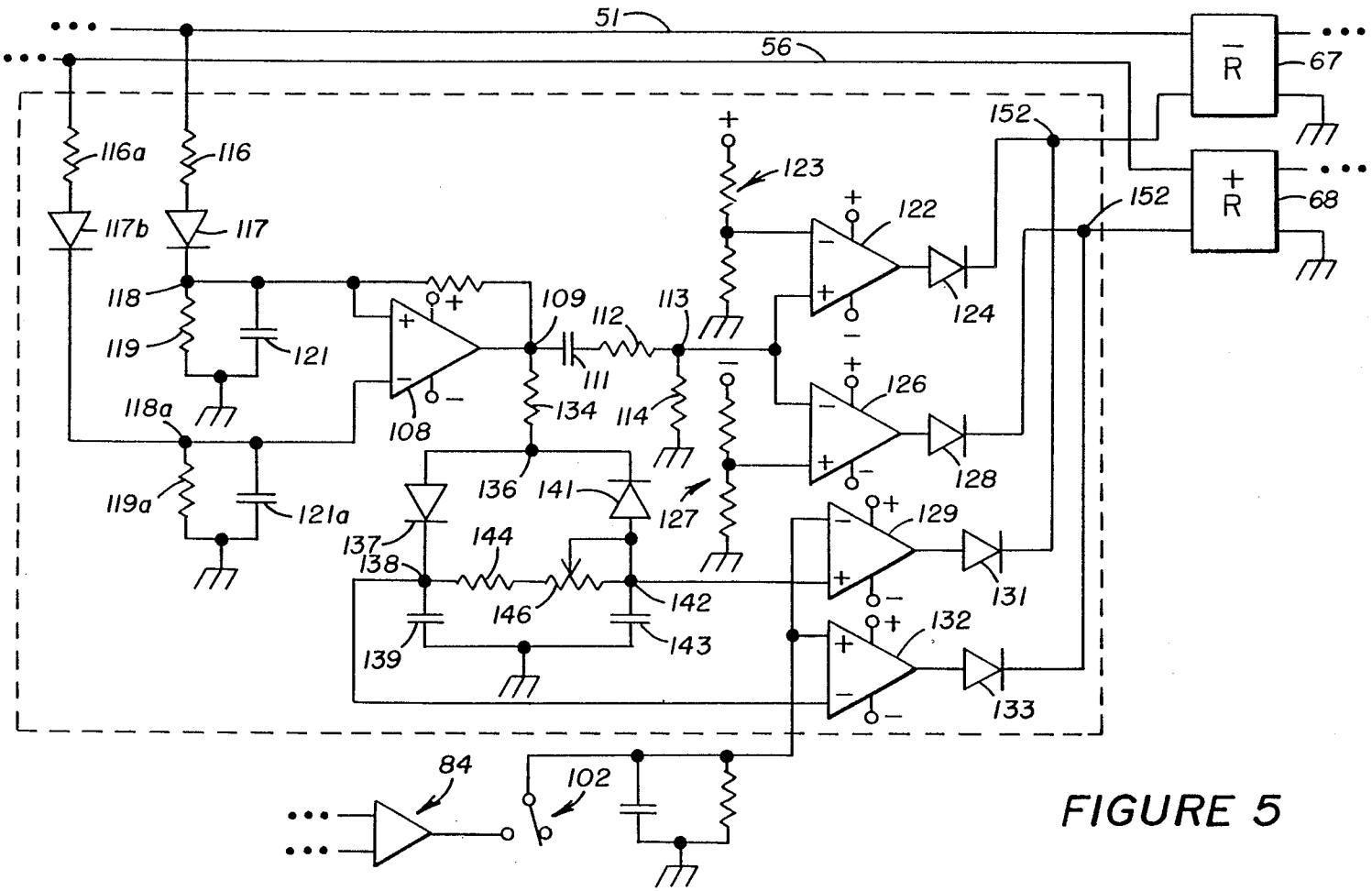
FIG. 5 is an electrical circuit diagram showing a timer circuit of FIG. 4 in greater detail.

The timer circuit 106 may have any of a number of internal configurations, an advantageous example of which is depicted in FIG. 5. The circuit 106 of this example has a voltage level detecting amplifier 108 with an output terminal 109 that is connected to ground through a differentiating circuit formed by a capacitor 111, resistor 112, circuit junction 113 and another resistor 114 which are connected in series between the amplifier output and ground. Thus a momentary positive voltage appears at junction 113 each time that the amplifier output 109 goes from a negative state to a positive state and a negative voltage is briefly present at the junction when the polarity of the amplifier output switches in an opposite direction.

The polarity shifts at amplifier output 109 occur in response to the alternate transmissions of high voltage generator actuating current on cable conductors 51 and 56. For this purpose, a resistor 116, diode 117, circuit junction 118 and another resistor 119 are series connected between cable conductor 51 and ground. Resistors 116 and 119 form a voltage divider which reduces the relatively high A.C. voltage on conductor 51 to a level compatible with the D.C. amplifier 108. Diode 117 rectifies the A.C. voltage so that only positive voltage is presented to the amplifier 108. A capacitor 121 is connected in parallel with resistor 119 to provide a limited degree of signal integration, the time constant of the integrating circuit formed by capacitor 121 and resistor 119 being around three milliseconds for example. This avoids a change of state of the amplifier 108 output 109 in response to each half cycle of the A.C. voltage on cable conductor 51.

The other cable conductor 56 is similarly connected to ground through a resistor 116*a*, diode 117*a*, circuit junction 118*a* and resistor 119*a* with a capacitor 121*a* being connected in parallel with the latter, which components have functions similar to those described with respect to their counterparts 116 to 121.

Circuit junctions 118 and 118*a* are connected to the non-inverting and inverting inputs respectively of amplifier 108. Thus the output 109 of amplifier 108 becomes positive at the start of each period of transmission of alternating current on cable conductor 51 and switches to the negative state at the conclusion of each such period in response to the following transmission of alternating current on cable conductor 56.

The change of polarity at amplifier output 109 following each ion generation period produces a momentary voltage spike at the differentiator junction 113 as previously described. The non-inverting input of a first comparator amplifier 122 is connected to junction 113 and the inverting input of the same amplifier receives a positive voltage from a voltage divider 123 that is smaller than the momentary positive voltage that appears at junction 113 after each ion generation period. Consequently, the output of comparator 122 momentarily switches to a high condition following each positive ion generation period and temporarily energizes the driver circuit of relay 67 through a diode 124. This briefly closes relay 67 to produce the desired momentary production of negative ions at that time.

The inverting input of a second comparator amplifier 126 is also connected to circuit junction 113. The non-inverting input of the second comparator 126 receives a negative voltage from another voltage divider 127 that is smaller than the momentary negative voltage that occurs at junction 113 after a period of negative ion generation. The output of the second comparator 126 is connected to the driver circuit of the other relay 68 through another diode 128. Thus comparator 126 momentarily closes relay 68 following each period of negative ion generation to produce the desired brief pulse of positive ions.

The reopening of the relay 67 or 68 which concludes each of the brief ion generations discussed above, initiates the following off interval of no ion generation. A third comparator amplifier 129 is coupled to the driver circuit of relay 67 through another diode 131 and a fourth comparator amplifier 132 is similarly coupled to relay 68 through still another diode 133 to reclose the relays at the end of the off intervals and thereby initiate the periods of sustained ion generation. The timing of such actions by comparators 129 and 132 and thus the duration of each off interval is controlled by the feedback signal voltage from amplifier 84 and switch 102.

In particular, the feedback signal is transmitted to the inverting input of third comparator 129 and also to the non-inverting input of fourth comparator 132. To control the triggering of the comparators 129, 132, a resistor 134, circuit junction 136, diode 137, circuit junction 138 and capacitor 139 are connected in series between the output terminal 109 of level detector amplifier 108 and ground. Another diode 141, Circuit junction 142 and capacitor 143 are connected between junction 136 and ground. Circuit junctions 132 and 142 are interconnected through a fixed resistor 144 and a variable resistor 146 which are in series relationship.

Diode 137 is oriented to enable positive charging of capacitor 143 from the output 109 of amplifier 108, through resistors 144 and 146, during the negative ion generation periods at which output 109 is in the positive state as previously described. Diode 141 is oppositely oriented to enable negative charging of capacitor 139 during the positive ion generation periods. At the start of such a period of negative charging of capacitor 139, the capacitor has a positive charge acquired through diode 137 during the preceding period of positive charging of capacitor 143. A time interval, determinined by the values of the capacitor 139 and resistors 134, 144 and 146, is required for charge on the capacitor and thus at circuit junction 138 to be reversed and become negative. Junction 138 is connected to the inverting input of fourth comparator 132. Thus after the interval of time required for capacitor 139 to acquire a negative charge equal to the feedback signal voltage, comparator 132 is triggered to reclose relay 68. This ends the off interval and begins a sustained period of positive ion generation which continues until the control console ends the ion generation period by de-energizing cable conductor 56 as previously described.

Circuit junction 142 is connected to the non-inverting input of third comparator 129 and thus a similar cycling of relay 67 occurs during the negative ion generation periods.

If the feedback signal voltage (which has been inverted at amplifier 74) becomes more negative due to an increased content of positive ions in the atmosphere, a longer period of time is needed for the charge at junction 138 to rise to that value. Thus the positive ion generation period is interrupted for a longer interval thereby reducing positive ion production. A less negative feedback signal shortens the charging time and causes increased positive ion output. Changes in the feedback signal during negative ion generation periods have a similar effect on negative ion output by changing the timing of the closings of relay 67 in an essentially similar manner.

The duration of the off interval caused by a feedback signal of given magnitude can be selected by adjusting variable resistor 146 as this changes the time required for charging of capacitors 139 and 143.

Referring again to FIG. 3, a capacitor 147 and resistor 148 are connected in parallel between the feedback signal input 149 to timer circuit 106 and chassis ground to provide a degree of feedback signal integration. The preferred time constant of the integrating means 151, i.e. the product of the capacitance and resistance, is dependent on the conditions under which the particular installation is to operate. If the time constant is made relatively low, below about 200 seconds for example, the ionizing apparatus 11 will operate on what may be called a pulse by pulse basis. The response of the sensor 16 and feedback module 17 to changes in air ion content is sufficiently fast that a change in air ion content in the vicinity of the sensor results in a substantial change in ion output during the current or immediately following ion generation period. This is a desirable mode of operation under many conditions, most notably where each emitter unit 13 is provided with its own local sensor 16 and feedback module 17.

Under certain other conditions, it is preferable to slow the response of the feedback system to avoid unnecessary production of ions. A fast feedback system can cause an over-production of ions, for example, in situations where a single sensor 16 controls a number of ion emitter units 13 or where the sensor is situated a substantial distance away from an emitter unit. Under those conditions, a sensed change in air ion content in the vicinity of the sensor 16 may be a momentary one confined to that vicinity and may not be indicative of a need for a change in ion output at the locations of the emitter units 13.

Sensed changes of air ion content that persist through a number of cycles of ion generation are more indicative of a general change in ion content throughout the room that calls for a change in ion output. The feedback system can be caused to react primarily to such long term changes in sensed air ion content, rather than to momentary fluctuations, by increasing the degree of integration of the feedback signal. To bring about this mode of operation in a typical clean room or the like, capacitor 147 and resistor 148 may have values which establish a time constant in the range from about 300 to about 700 seconds although other values may be appropriate in some instances.

It may be noted that there is a limited degree of feedback signal integration in the circuit in the absence of integrating means 151. Capacitor 78 and resistors 76 and 77 in the sensor 16 circuit and capacitor 89 and resistor 88 at the inputs to amplifier 84 provide some integration but do not collectively have a sufficiently high time constant to slow response of the system to the extent that is desirable under certain operating conditions. As pointed out above, a substantial change in the magnitude of the feedback signal voltage can occur in the course of a single period of ion generation in the absence of the additional integrating means 151.

During start up of the ionizing apparatus 11 at a particular location switch 102 is temporarily opened and positive voltage from a suitable source is temporarily applied directly to the driver circuit terminals 152 of relays 67 and 68 to hold the relays in the closed condition. This inactivates the feedback system and causes uninterrupted periods of positive ion generation to alternate with uninterrupted periods of negative ion generation. The ion content of the air is then detected with a charged plate monitor or other ion detector. Referring again to FIG. 2, the several controls 48, 53 and 64 of the control console 14 are then adjusted until it is observed with the monitor that the desired air ion content is present and that any cyclical variation in the ratio of positive to negative ions at the work site, caused by the alternating periods of positive and negative ion production, is within acceptable limits. A voltage oscillation on ungrounded conductors at the work site that is limited to the range of about +100 volts to about −100 volts will not usually cause any adverse effects from static electricity discharges and in many cases a wider voltage swing is tolerable.

After the above described tuning of the system to meet the needs of the particular installation, the timing signal controls 64 of pulse generator 59 are readjusted to extend the duration of the periodic portions of the timing signals 57 and 58 that call for ion generation. This provides an operating range within which the feedback process can vary the actual periods of ion generation as previously described if conditions change and longer ion generation periods are needed.

Referring again to FIG. 3, potentiometer 87 is then adjusted as previously described to center the feedback signal voltage level about the zero level and switch 102 is closed to activate the feedback process. Variable resistor 146 is then adjusted to limit the positive and negative peaks of the feedback signal to a range which is sufficiently small that positive and negative swings in air ion content are held within the desired limits. Reducing the resistance of resistor 146 causes comparators 129 and 132 to be triggered in response to smaller variations of the feedback signal and an increased resistance produces an opposite effect.

The ionizing apparatus 11 then operates in the manner previously described to maintain the selected concentrations of both positive and negative ions in the air at the work site under changing conditions where variations in the output rate of one or both types of ion may be needed to accomplish that objective.

The invention has been herein described with respect to apparatus 11 designed for electrostatic charge suppression. The method and apparatus can also be used in air ionizing operations for other purposes such as air purification for example. Air ions impart charge to particles of dust, pollen, smoke or the like. Electrostatic attraction then causes such particles to be deposited on nearby surfaces.

The invention has been herein described, for purposes of example, as embodied in an advantageous air ionizing installation 11 of a type which include a particular form of feedback control, specifically one which varies ion output rate by temporarily interrupting cyclical periods of ion generation. Feedback signal integration of the above described kind can also be employed, where conditions are appropriate, in air ionizing systems of the type which regulate ion output, in response to a sensor signal, by varying the high voltage on the ionizing electrodes. The hereinbefore described method and apparatus for abruptly ending ion generation at the end of each ion generation period is also adaptable to systems which use other forms of feedback control or to bipolar air ionizing systems that do not include sensors or feedback such as the system disclosed in the previously discussed prior U.S. Pat. No. 4,542,434.

For example, with reference to FIG. 3, if ion sensor 16, feedback module 17, relays 67 and 68 and D.C. power supply 70 are all eliminated from the apparatus, the system reverts essentially to that described in prior U.S. Pat. No. 4,542,434 and remains operable in the manner described in that patent. In particular, with reference FIG. 6, the timing pulse generator 59 may be adjusted to produce trains of repetitive pulses **57*a* and 58*b* on conductors 61 and 62 respectively that differ from those previously described in that pulse train 57*a* temporarily goes to the low state to close relay 49 during cyclical periods when train 58*b* is at the high state that opens relay 54. Similarly, pulse train 58*b* temporarily goes to the low state to close relay 54 during the cyclical periods when train 57*a* is at the high state and relay 49 is open. As in the above identified prior patent, these pulse train wave forms result in repetitive periods of energization of the positive high voltage generators being alternated with repetitive periods of energization of the negative high voltage generators, each period of energization being preceded by an off interval during which all high voltage generators are de-actuated. Unlike the previously described embodiment, the ion generation periods and off intervals have fixed durations determined by the settings at pulse generator 59** rather than variable durations controlled by a feedback signal.

A turn-off spike or brief energization of the opposite polarity high voltage generator following each sustained period of ion generation can be provided for in apparatus of this kind bycross connecting the timing signal conductors 61 and 62 with a pair of level detecting and differentiating circuits 153 and 154 which may be essentially of the form previously described with reference to FIG. 3. Thus, referring again to FIG. 6, circuit 153 may have a voltage level detecting amplifier 156 with a non-inverting input connected to conductor 62 through a resistor 157. The inverting input of amplifier 156 receives a positive voltage, from a voltage divider 158 that is lower than the voltage on conductor 62 when timing signal 58*a* is in its high condition. Thus the output of amplifier 156 goes high each time that timing signal 58*a* reverts to the high condition at the end of a period of positive ion generation.

The output of amplifier 156 is connected to ground through a differentiating circuit formed by a capacitor 159, resistor 161, circuit junction 162 and resistor 163. Thus a brief voltage rise occurs at junction 162 each time that the output of amplifier 156 goes high at the end of a period of positive ion generation. This brief voltage rise is transmitted to the base of an NPN transistor 164 which has a grounded emitter and a collector connected to signal conductor 61. Thus the transistor 164 is momentarily biased into conduction at such times and briefly drops the voltage on conductor 61. This causes a brief closing of relay 49 that results in the desired momentary generation of negative ions.

Circuit 154 may be similar and thus includes an amplifier 156*a* with a non-inverting input connected to conductor 61 through a resistor 157*a* and an inverting input that receives reference voltage from a voltage divider 158*a*. A capacitor 159*a*, resistor 161*a*, junction 162*a* and resistor 163*a* are series connected between the output of amplifier 156*a* and ground and a transistor 164*a* regrounding to brief voltage rises at junction 162*a* by briefly grounding signal conductor 62. Thus the circuit 154 closes relay 54 to produce a brief generation of positive ions, each time that waveform 57*a* reverts to the high condition, in the manner described above with respect to circuit 153.

While the invention has been disclosed with respect to certain specific examples, many other modifications and variations are possible and it is not intended to limit the invention except as defined in the following claims.

We claim:

1. In a method of maintaining the ion content of the atmosphere at a predetermined location within a desired range which includes the steps of alternating periods of positive ion generation by a positive ion generator with periods of negative ion generation by a separate negative ion generator and suppressing generation of ions of both polarities during intervals which precede each ion generation period, the improvement comprising:

momentarily generating a relatively brief burst of negative ions at said negative ion generator between each of said periods of positive ion generation and the following one of said intervals of suppressed ion generation, and momentarily generating a relatively brief burst of positive ions at said positive ion generator between each of said periods of negative ion generation and the following one of said intervals of suppressed ion generation.

2. The method of claim 1 including the further steps of:

generating timing signals which define repetitive time periods of a first sequence that alternate with repetitive time periods of a second sequence, initiating positive ion generation in response to starting of each time period of said first sequence and terminating said positive ion generation in response to ending of each time period of said first sequence, initiating negative ion generation in response to starting of each time period of said second sequence and terminating said negative ion generation in response to ending of each time period of said second sequence, and temporarily suppressing the generation of ions for an interval during each of said time periods of said first and second sequences to establish said momentary generations of ions and the following intervals of ion generation suppression.

3. The method of claim 2 including the further steps of:

sensing changes in said ion content of said atmosphere at said location to produce a feedback signal which is indicative of said changes, and varying the duration of said intervals of ion generation suppression in response to said feedback signal following each of said momentary generations of ions to maintain said ion content within a predetermined range.

4. The method of claim 3 including the further step of integrating said feedback signal to suppress brief fluctuations therein that do not persist through a plurality of said time periods.

5. In a method of controlling the ion content of the atmosphere at a predetermined location, the sequence of steps comprising:

generating ions of a first polarity in said atmosphere during a first limited time period by temporarily actuating a first ion generator that produces only ions of said first polarity, generating ions of the opposite polarity in said atmosphere during a relatively brief second time period that follows said first time period by briefly actuating a second ion generator that produces only ions of said opposite polarity, suppressing ion generation during a third time period that follows said second time period generating ions of said opposite polarity during a fourth time period that follows said third time period by temporarily actuating said second ion generator, generating ions of said first polarity during a relatively brief fifth time period that follows said fourth time period by briefly actuating said first ion generator, suppressing ion generation during a sixth time period that follows said fifth time period, and wherein said sequence of steps is performed repetitively.

6. In apparatus for controlling the ion content of the atmosphere at a predetermined location, said apparatus having at least one positive high voltage generator and positive ion emitter electrode and at least one negative high voltage generator and negative ion emitter electrode and control means for cyclically actuating and deactuating said high voltage generators with periods of positive ion generation being alternated with periods of negative ion generation and with each period of ion generation being preceded by an interval during which generation of ions of both polarities is suppressed, the improvement comprising:

first circuit means for causing a relatively brief actuation of said negative high voltage generator between each of said periods of positive ion generation and the following one of said intervals of ion generation suppression, and second circuit means for causing a relatively brief actuation of said positive high voltage generator between each of said periods of negative ion generation and the following one of said intervals of ion generation suppression.

7. The apparatus of claim 6 further including:

timing means for establishing repetitive positive ion generation periods during which said positive high voltage generator is actuated and repetitive negative ion generation periods that alternate with said positive ion generation periods and during which said negative high voltage generator is actuated, wherein said first circuit means produces said brief actuations of said negative high voltage generator and the following intervals of ion emission suppression by temporarily deactuating said negative high voltage generator during each of said negative ion generation periods, and wherein said second circuit means produces said brief actuations of said positive high voltage generator and the following intervals of ion emission suppression by temporarily deactuating said positive high voltage generator during each of said positive ion generation periods.

8. The apparatus of claim 7 further including an air ion sensor having means for producing a feedback signal that varies in accordance with variations of said ion content of said atmosphere, and feedback circuit means for varying the duration of said intervals of ion emission suppression that follow said brief actuations of said high voltage generators to maintain said ion content within said desired range.

9. The apparatus of claim 8 further including means for integrating said feedback signal, said integrating means having a time constant sufficient to suppress fluctuations in said signal that are confined to a single one of said periods of ion generation.

10. The apparatus of claim 6 further including:

first and second relays, means for transmitting actuating current to said positive high voltage generator through said first relay during each of a sequence of repetitive positive ion generation time periods that alternate with repetitive negative ion generation time periods, means for transmitting actuating current to said negative high voltage generator through said second relay during said negative ion generation time periods, wherein said first circuit means temporarily opens said second relay during said negative ion generation periods and said second circuit means temporarily opens said first relay during said positive ion generation periods.

11. The apparatus of claim 10 wherein said first circuit means opens said second relay a predetermined time after the beginning of each of said negative ion generation periods, said predetermined time being sufficient to enable said brief actuation of said negative high voltage generator, and wherein said second circuit means opens said first relay a predetermined time after the beginning of each of said positive ion generation periods which predetermined time is sufficient to enable said brief actuation of said positive high voltage generator.

12. The apparatus of claim 11 wherein said first circuit means holds said second relay in said open condition and said second circuit means holds said first relay in said open condition for periods sufficient to provide said intervals during which emission of ions of both polarities is suppressed.

13. The apparatus of claim 12 further including:

an air ion sensor having means for generating a feedback signal voltage which varies in accordance with the magnitude and net polarity of said air ion content of said atmosphere, means for increasing the duration of said intervals of ion emission suppression during positive ion generation periods when said feedback signal voltage indicates an increasing positive ion content in said atmosphere and for decreasing the duration of said intervals during positive ion generation periods when said signal indicates a decreasing positive ion content in said atmosphere, and means for increasing the duration of said intervals of ion emission suppression during negative ion generation periods when said feedback signal voltage indicates an increasing negative ion content in said atmosphere and for decreasing the duration of said intervals during negative ion generation periods when said signal indicates a decreasing negative ion content in said atmosphere.

14. Apparatus for maintaining the ion content of the atmosphere at a predetermined location within a desired range comprising:

first and second spaced apart air ionzing electrodes, a positive high voltage generator coupled to said first electrode and a negative high voltage generator coupled to said second electrode, control means for cyclically actuating and deactuating said positive and negative high voltage generators with periods of actuation of said positive high voltage generator being alternated with periods of actuation of said negative high voltage generator and with each period of actuation of a high voltage generator being preceded by an interval during which both high voltage generators are deactuated, an ion sensor for detecting said ion content of said atmosphere and having means for producing a signal indicative of the magnitude and net polarity of said ion content, feedback means for varying the ion outputs of said high voltage generators during said ion generation periods in response to said signal to maintain said ion content within said desired range, and means for relatively briefly actuating said negative high voltage generator after each of said periods of actuation of said positive high voltage generator and for relatively briefly actuating said positive high voltage generator after each of said periods of actuation of said negative high voltage generator.

15. In a method for maintaining the ion content of the atmosphere at a predetermined location within a desired range of ion concentrations, which method includes the steps of generating positive and negative ions at different spaced apart points in said atmosphere wherein periods of positive ion generation are alternated with periods of negative ion generation and wherein the periods of ion generation are preceded by intervals during which generation of both positive and negative ions is suppressed, the improvement comprising:

producing a feedback signal by sensing changes in the ion content of said atmosphere in the vicinity of said predetermined location which signal has a magnitude and polarity that varies in accordance with variations of the magnitude and net polarity of said ion content of said atmosphere at said predetermined location, integrating said signal to suppress the effect thereon of brief fluctuations of said ion content that do not persist through a plurality of said ion generation periods, and varying the amount of the ions which are generated during said periods of positive and negative ion generation in response to the integrated signal to maintain said ion content within said desired range.

16. The method of claim 15 wherein said step of varying the amount of the ions which are generated during said periods of positive and negative ion generation is accomplished by temporarily interrupting each of said periods, and by varying the duration of said interruptions in response to changes in said integrated feedback signal.

17. The method of claim 16 including the further steps of:

increasing the duration of the interruptions of said positive ion generation periods when said integrated feedback signal indicates a predetermined maximum positive ion content in said atmosphere and decreasing said duration of the interruptions of said positive ion generation periods when said integrated feedback signal indicates a predetermined minimum positive ion content in said atmosphere, and increasing the duration of the interruptions of said negative ion generation periods when said integrated feedback signal indicates a predetermined maximum negative ion content in said atmosphere and decreasing said duration of the interruptions of said negative ion generation periods when said integrated feedback signal indicates a predetermined mimimum negative ion content in said atmosphere.

18. Apparatus for maintaining the ion content of the atmosphere at a predetermined location within a desired range comprising:

a plurality of spaced apart air ionizing electrodes including at least a first electrode and a second separate spaced apart electrode, a plurality of high voltage generators including a positive high voltage generator coupled to said first electrode and a negative high voltage generator coupled to said second electrode, control means for cyclically actuating and deactuating said positive and negative high voltage generators with periods of actuation of said positive high voltage generator being alternated with periods of actuation of said negative high voltage generator and with each period of actuation of a high voltage generator being preceded by an interval during which both high voltage generators are deactuated, a sensor for detecting said ion content of said atmosphere and having means for producing a signal which has a magnitude and polarity that varies in accordance with variations of the magnitude and net polarity of said ion content of said atmosphere at said predetermined location, means for integrating said signal to produce an integrated signal that varies primarily in response to changes in said ion content at said predetermined location that persist through a plurality of actuations of said high voltage generators and in which the effect of relatively brief fluctuations in said ion content of said atmosphere is suppressed, and feedback means for varying the ion outputs at said high voltage generators and electrodes during said ion generation periods in response to the integrated signal to maintain said ion content at said predetermined location within said desired range.

* * * * *

UNITED STATES PATENT AND TRADEMARK OFFICE

CERTIFICATE OF CORRECTION

PATENT NO. : 4,901,194

DATED : Feb. 13, 1990

INVENTOR(S) : Arnold J. Steinman and Michael G. Yost

It is certified that error appears in the above-identified patent and that said Letters Patent is hereby corrected as shown below:

Column 17, line 48, delete "grounding" and insert --spond--.

Signed and Sealed this

Sixth Day of October, 1992

*Attest:*

DOUGLAS B. COMER

*Attesting Officer*

*Acting Commissioner of Patents and Trademarks*